US005861736A

United States Patent [19]

Corsi et al.

[11] Patent Number: 5,861,736

[45] **Date of Patent: *Jan. 19, 1999**

[54] CIRCUIT AND METHOD FOR REGULATING A VOLTAGE

[75] Inventors: Marco Corsi; Nicolas Salamina, both of Dallas; Jeffrey W. Sanders, Plano; Michael R. Kay, Richardson, all of Tex.

[73] Assignee: Texas Instruments Incorporated, Dallas, Tex.

[ * ] Notice: The terminal 12 months of this patent has been disclaimed.

[21] Appl. No.: 348,670

[22] Filed: Dec. 1, 1994

[51] Int. Cl.[6] ..... G05F 1/575

[52] U.S. Cl. ..... 323/273; 323/280

[58] Field of Search ..... 323/265, 273, 323/274, 280, 281, 275

[56] References Cited

U.S. PATENT DOCUMENTS

| | | | |
|---|---|---|---|
| 4,127,885 | 11/1978 | Adam et al. | 361/18 |
| 4,636,710 | 1/1987 | Stanojevic | 323/280 |
| 4,728,901 | 3/1988 | Pepper | 330/260 |
| 4,950,975 | 8/1990 | Fleischer | 323/266 |
| 5,298,869 | 3/1994 | Jinich et al. | 330/286 |
| 5,305,192 | 4/1994 | Bonte et al. | 363/21 |
| 5,334,928 | 8/1994 | Dobkin et al. | 323/280 |

OTHER PUBLICATIONS

"LM78XX Series Voltage Regulators" *National Semiconductor* pp. 1–271 National Semiconductor General Purpose Linear Devices Databook Published 1989.

"LM2931 Series Low Dropout Regulators" *National Semiconductor* pp. 1–220 through 1–225 National Semiconductor General Purpose Linear Devices Databook Published 1989.

Article by Frank Goodenough "Tiny IC Plus FET Building Super LDO Regulator" *Electronic Design*, Mar. 1994, pp. 45–49.

*Primary Examiner*—Adolf Deneke Berhane
*Attorney, Agent, or Firm*—Alan K. Stewart; Wade James Brady, III; Richard L. Donaldson

[57] ABSTRACT

A voltage regulator circuit (10) is provided. Regulator circuit (10) includes an amplifier (18) with an emitter follower output stage (26). Emitter follower stage (26) is coupled to a gate of a PMOS transistor (28). The source of transistor (28) is coupled to an input voltage at a power supply rail (12). Regulator (10) provides an output at node (14) at a drain of transistor (28). The output at node (14) is divided by resistors (30 and 34) and provided in a negative feedback loop to an input of amplifier (18). A reference voltage (22) is also provided to a second input of amplifier (18) such that the output at node (14) is a regulated voltage.

12 Claims, 2 Drawing Sheets

CIRCUIT AND METHOD FOR REGULATING A VOLTAGE

TECHNICAL FIELD OF THE INVENTION

This invention relates in general to the field of electronic devices. More particularly, this invention relates to a circuit and method for regulating a voltage.

BACKGROUND OF THE INVENTION

Many electronic circuits require a relatively constant voltage source to operate properly. Such circuits are typically powered by an energy source such as main power or a battery. Unfortunately, the output voltage of these energy sources may fluctuate substantially. Therefore, the electronics art has developed various regulator circuits that convert the voltage of the energy source to a relatively constant voltage for use by other circuits.

Several aspects of a voltage regulator may limit its effectiveness in a particular circuit. For example, some regulators have a high "drop out" voltage. Drop-out voltage is the minimum voltage difference between the input and output voltages of the regulator necessary to maintain output regulation. Other regulators are only stable for a narrow range of load impedances. Some regulators also go out of regulation when the load goes into an idle state that requires an insignificant quantity of current. Voltage regulators typically use negative feedback to maintain a substantially constant output voltage despite significant fluctuations in the energy source and load. One type of regulator using negative feedback is a linear regulator. A linear regulator may, for example, include a dissipative element such as an NPN bipolar junction transistor that is controlled by an amplifier coupled to the base of the transistor in a negative feedback loop. The transistor thus imposes a variable voltage drop between the input and output of the regulator. The voltage at the regulator output can be controlled by adjusting the conductance of the transistor. It is noted that other dissipative elements may be substituted for the NPN transistor.

This type of linear regulator typically has a significant problem in that it has a high drop-out voltage which limits the minimum input voltage that may be accepted by the circuit. The drop-out voltage of the linear regulator is caused by the cumulative effect of two factors. First, the potential at the base of the transistor is greater than the potential at the output of the regulator by approximately one diode voltage drop across the base-emitter junction of the transistor. Second, the amplifier must be capable of establishing the voltage at the base of the transistor to establish this diode voltage drop. These two factors combine to represent a drop-out voltage of at least one volt, and perhaps as much as two volts in regulators using a Darlington pair, because the amplifier is typically powered by the input to the regulator. When the regulator is provided with insufficient input voltage, its output voltage drops out of regulation. A regulator of this type may thus have a drop-out voltage on the order of one to two volts.

A large drop-out voltage has several bad effects. First, as discussed above, the drop-out voltage limits the minimum input voltage which can be used with the regulator. Additionally, the drop-out voltage represents wasted power. Furthermore, the power dissipated by the regulator is turned into heat, which must be dissipated by a heat sink or fan.

Heretofore known regulators have been developed to provide a low drop-out voltage (hereinafter "LDO regulator"). An LDO regulator typically uses a lateral PNP bipolar junction transistor as an output device. An amplifier is coupled to the base of the PNP transistor in a negative feedback loop for controlling the output voltage at the collector of the PNP transistor. A reference voltage is applied to another input of the amplifier. Negative feedback allows the regulator to maintain a substantially constant output voltage at the collector of the PNP transistor. If the output voltage decreases slightly, the output of the amplifier reduces the voltage across the base-emitter junction of the PNP transistor which causes the transistor to conduct more current and thus brings the output voltage back up to the desired voltage.

The PNP LDO regulator provides for a low drop-out voltage because the drop-out of the PNP transistor is limited only by its inherent saturation voltage plus any ohmic losses in the emitter and collector of the transistor. This type of device may provide a drop-out voltage at full current of less than one-half a volt.

LDO regulators that use PNP output transistors also have several problems. First, the open-loop output impedance of the PNP LDO regulator is relatively large. The high open-loop output impedance leads to stringent stability requirements which limit the range of load impedances that may properly operate from the output of the regulator. Negative feedback is used to achieve a low closed loop output impedance for the voltage regulator. As described above, the feedback loop adjusts the voltage of the base of the PNP transistor so as to oppose any change in output voltage. If the loop is not properly compensated, the output voltage will become unstable and will oscillate. The requirements of loop compensation thus limit the range of load impedances which may be used with the PNP LDO regulator. Finally, the operating performance of the PNP transistor is inferior to the operating performance of the NPN transistor.

The stability of a PNP LDO regulator is determined by the frequency associated with two poles of the system. First, the load that is coupled to the LDO regulator introduces a pole into the system (the "load pole"). The load pole is caused by the combination of the capacitance and the resistance of the load itself. Therefore, the location of this pole is not controlled by the design of the LDO. Unfortunately, this pole is not stationary. In fact, the frequency of the pole changes with the operation of the load. The second pole is caused by a parasitic capacitance at the base of the PNP transistor in combination with the output resistance of the amplifier (the "parasitic pole"). Due to the size of the parasitic capacitance of the PNP transistor, the parasitic pole is located at a low frequency and may be within the audio range. Therefore, the LDO regulator coupled to a load may be approximated as a two pole system resulting in a 180° phase shift. This phase shift reduces the system's phase margin and the system may thus begin to oscillate depending on the location of the load pole. A typical solution is to utilize the equivalent series resistance (ESR) of a capacitor at the output of the LDO to introduce a zero into the system to compensate for one of the poles. However, the addition of an ESR zero does not entirely eliminate the stability problem because the load pole still depends on the load impedance, and the ESR zero may not be able to stabilize the regulator for all load impedances.

The PNP transistor itself limits the usefulness of a PNP LDO. First, the high-current beta of a PNP transistor is very limited in comparison to the high-current beta of a comparable NPN transistor. Additionally, the base current causes poor efficiency because current is taken from the emitter and passed through the base to ground resulting in an efficiency loss. Finally, a lateral PNP transistor exhibits substrate injection in saturation which results in a loss of current and efficiency.

A PMOS transistor may be used in place of the PNP transistor to reduce or eliminate several problems of the PNP described above. For example, the PMOS transistor does not experience the high-current beta limitation of the PNP counterpart nor the efficiency loss due to base current. Rather, the PMOS transistor merely conducts current between source and drain without any appreciable current loss at its gate. Additionally, the PMOS LDO regulator does not experience substrate injection. However, the PMOS LDO regulator does not improve the stability over PNP LDO regulators.

Some circuit designers have tried to cure the stability problem with a CMOS solution by using an NMOS follower as the output stage of the amplifier that controls the PMOS transistor. Such circuits have not adequately addressed the stability problem. In fact, the design of these CMOS circuits introduces significant design problems in setting the threshold voltage of the transistors in the NMOS follower. If the threshold voltage of the. NMOS follower is set at a relatively low absolute value so that the PMOS output transistor may be turned off, the NMOS transistor cannot be turned off. If the threshold voltage of the NMOS follower is set high, then the absolute value of the PMOS output transistor's threshold voltage must be proportionately increased, reducing the available gate drive and requiring an increase in transistor size.

SUMMARY OF THE INVENTION

The present invention provides a circuit and method for regulating a voltage that eliminates or reduces problems associated with prior circuits and methods. More particularly, in one embodiment, the present invention provides a BiCMOS integrated circuit for regulating a fluctuating input voltage to provide a substantially constant output voltage that is stable for a wide range of load impedances. The circuit comprises three stages—an amplifier stage, a bipolar emitter follower stage, and an output stage. The output of the amplifier stage is coupled to the input of the bipolar emitter follower stage. The output of the emitter follower stage is coupled to the input of the output stage at the gate of a MOS transistor. The drain of the MOS transistor comprises the output of the circuit. This drain is also coupled to a first input of the amplifier to provide negative feedback for the circuit. A reference voltage source is coupled to a second input of the amplifier stage. The input voltage to be regulated is supplied to the amplifier stage, the bipolar emitter stage and the source of the MOS transistor in the output stage. Ultimately, the regulator circuit provides a regulated output that is substantially constant.

According to another aspect of the present invention, the emitter follower stage may be fabricated with various combinations of emitter follower stages. For example, a PNP emitter follower may be cascaded with an NPN emitter follower. Alternatively, the emitter follower stage may include a NPN transistor and a PNP transistor coupled together at their respective emitters. Additionally, the emitter follower stage may comprise a traditional PNP or NPN emitter follower.

A technical advantage of the present invention is that it provides a regulator with a low drop-out voltage that is stable over a wide range of load impedances. The range of load impedances is improved over traditional PMOS LDO regulators by establishing a parasitic pole of the PMOS transistor at a sufficiently high frequency. In one embodiment, a circuit constructed according to the teachings of the present invention uses an emitter follower stage to decrease the output impedance of the amplifier. This output impedance in combination with the parasitic capacitance at the gate of the PMOS transistor establishes the parasitic pole of a sufficiently high frequency. This creates a relatively high open loop bandwidth of the LDO regulator and provides better response to transient fluctuations in the input voltage. Therefore, the acceptable range of load impedances increases because the frequency of the load pole may fluctuate substantially without causing the regulator to become unstable.

Another technical advantage of the present invention is that in one embodiment it provides a cascaded emitter follower stage that further reduces the output resistance of the amplifier thus further increasing the range of load impedances that may be used with the regulator. Additionally, the cascaded emitter follower configuration reduces the level of the control voltage required to control the emitter follower stage, which may be advantageous to the design of the amplifier.

Another technical advantage of the present invention is that the output of the regulator stays substantially constant even when the load enters an idle state and draws an insignificant amount of current from the regulator. The emitter follower stage controls the voltage at the gate of the output PMOS transistor. When the load goes into an idle state, the emitter follower may adjust the gate voltage such that the absolute value of the gate to source voltage is less than the threshold voltage of the PMOS transistor. Therefore, the emitter follower stage causes the PMOS transistor to conduct an insignificant quantity of current. This is referred to as the "off" state of the PMOS transistor.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein.

DETAILED DESCRIPTION OF THE INVENTION

Figure 1:
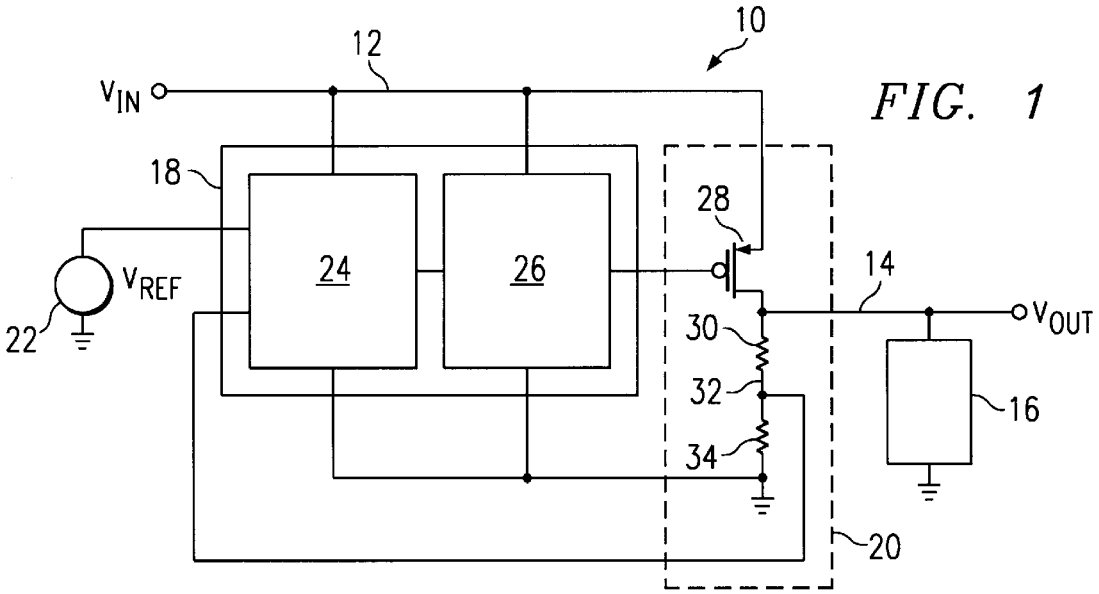
FIG. 1 is a block diagram of one embodiment of a voltage regulator circuit constructed according to the teachings of the present invention.

FIG. 1 is a block diagram illustrating an embodiment of a voltage regulator circuit, indicated generally at 10, and constructed according to the teachings of the present invention. An input voltage, labeled $V_{in}$, is supplied to circuit 10 at power supply rail 12. The input voltage may, for example, be provided by a battery or other appropriate power source with transient fluctuations. Circuit 10 regulates the input voltage at supply rail 12 to provide an output voltage at node 14, labelled $V_{out}$, that is stable for a wide range of loads 16. Load 16 may comprise, for example, a cellular telephone or any other appropriate electronic device that is powered by a battery. Circuit 10 also provides a low drop-out voltage.

Circuit 10 comprises an amplifier 18 with a low output impedance, an output stage 20 and a reference voltage source 22. Amplifier 18 and output stage 20 are both coupled to power supply rail 12 and a ground potential as shown in FIG. 1. Amplifier 18 comprises an amplifier stage 24 that is coupled to an emitter follower stage 26. Emitter follower 26 provides a low output impedance for amplifier 18 that is coupled to an input of output stage 20. As shown in FIGS. 2 through 5, emitter follower stage 26 may comprise any appropriate conventional bipolar emitter follower stage that provides a low output impedance.

Output stage 20 comprises a PMOS transistor 28. A gate of transistor 28 is coupled to an output of emitter follower 26. A source of transistor 28 is coupled to power supply rail 12. A drain of transistor 28 is coupled to output node 14. Additionally, a first resistor 30 is coupled at one end to a node 14 and at the other end to a node 32. A second resistor 34 is coupled between node 32 and a ground potential. Resistors 30 and 34 provide a voltage divider for output circuit 20. Node 32 is coupled to a first input of amplifier 18 to provide negative feedback for circuit 10.

Reference voltage supply 22 is coupled to a second input of amplifier 18 to control the regulated output of circuit 10. Reference voltage supply 22 may be established by a zener diode and a current source or alternatively, a bandgap reference circuit. The reference voltage may, for example, be on the order of 1.25 volts. Other voltage references known in the art for producing a reference voltage may also be used for reference voltage supply 22.

In operation, circuit 10 regulates the input voltage at power supply rail 12 to provide a substantially constant output voltage at node 14 for a wide range of load impedances. The regulated voltage at node 14 is determined by the reference voltage supply 22 and the negative feedback from output stage 20 to amplifier 18. The voltage at node 14 is divided by resistors 30 and 34 which form a voltage divider. The value of resistors 30 and 34 may be selected to provide an appropriate voltage at node 32 for feedback to amplifier 18. If the voltage at node 14 falls below the desired output voltage, amplifier 18 compensates by decreasing the output of emitter follower stage 26. This causes PMOS transistor 28 to conduct more current between its source and drain and thus returns the output voltage to the desired level.

Circuit 10 operates with a wide range of loads 16 having various load impedances. As described above, circuit 10 may be approximated as a two pole system. These poles are the poles contributed by the load 16 and a parasitic capacitance of PMOS transistor 28 in combination with the output resistance of amplifier 18. It is noted that other poles may exist in circuit 10. However, the dominant poles for the system are the load pole and the parasitic pole associated with PMOS transistor 28.

Circuit 10 provides a stable output at node 14 over a wide range of loads 16 due to the low output impedance of emitter follower stage 26. The equivalent output impedance of emitter follower stage 26 combines with the parasitic capacitance between the source and gate of PMOS transistor 28 to create a parasitic pole for circuit 10. By using emitter follower stage 26, this parasitic pole is located at a substantially high frequency such that the open loop bandwidth of circuit 10 is increased. This improves the phase margin of circuit 10 and prevents circuit 10 from oscillating at output 14 for loads 16 having a wide variety of impedances. Therefore, the present invention combines the desirable low output impedance of a bipolar emitter follower stage with the desirable features of a PMOS regulator on a single integrated circuit chip. Circuit 10 therefore may be fabricated with conventional biCMOS technology. This produces a regulator 10 that may provide a stable output voltage at node 14 over a wide range of load impedances.

Circuit 10 also provides an additional technical advantage in that emitter follower stage 26 may "turn off" output stage 20 when load 16 enters an idle state. During operation, load 16 may enter a state in which load 16 requires an insignificant amount of current. This is commonly referred to as the idle state of load 16. During this idle state, the output voltage at node 14 should remain constant. In order to produce this constant voltage at output node 14, circuit 10 must be able to cause transistor 28 to provide an insignificant amount of current to load 16. In this state, transistor 28 is said to be "off". Emitter follower circuit 26 turns off transistor 28 by controlling the voltage of the gate of transistor 28. When the voltage difference between the gate and source of transistor 28 is substantially less than the threshold voltage of transistor 28, transistor 28 is substantially turned off. Therefore, the magnitude of the threshold voltage of transistor 28 must be large enough to allow emitter follower circuit 26 to turn off transistor 28. For example, the magnitude of the threshold voltage of transistor 28 may be on the order of one volt so as to compensate for an approximate diode voltage drop across the base-emitter junction of a transistor in emitter follower circuit 26. This allows emitter follower circuit 26 to turn off transistor 28 when load circuit 16 enters an idle state.

Figure 2:
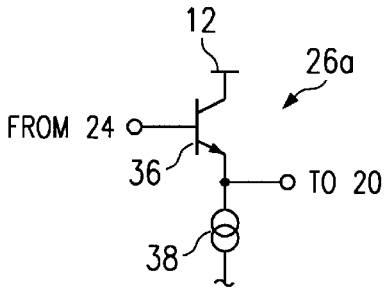
FIG. 2 is a circuit schematic of one embodiment of an emitter follower stage for the circuit of FIG. 1 and constructed according to the teachings of the present invention.

Emitter follower circuit 26 may comprise any one of a number of conventional emitter follower circuits. FIGS. 2 through 5 are circuit schematics that illustrate various emitter follower circuits that may be used in circuit 10. For example, FIG. 2 illustrates an emitter follower circuit indicated generally at **26*a* that comprises an NPN bipolar junction transistor 36 having a collector coupled to power supply rail 12, a base coupled to an output of amplifier stage 24, and an emitter providing output to output stage 20. A current source 38 is coupled between the emitter of transistor 36 and a ground potential. Current source 38 may comprise, for example, an appropriately biased current mirror or any other appropriate circuit for establishing a current through transistor 26**.

Figure 3:
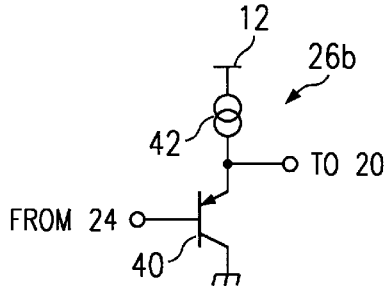
FIG. 3 is a circuit schematic of another embodiment of an emitter follower stage for the circuit of FIG. 1 and constructed according to the teachings of the present invention.

FIG. 3 illustrates another embodiment of an emitter follower stage indicated generally at **26*b* for use with circuit 10 of FIG. 1. Emitter follower circuit 26*b* comprises a PNP transistor 40 having a collector coupled to ground, a base coupled to an output from amplifier stage 24, and an emitter providing an output to output stage 20. Additionally, emitter follower stage 26*b* comprises a current source 42 coupled between power supply rail 12 and the emitter of transistor 40. Transistor 40** may be, for example, a substrate PNP transistor which takes advantage of the higher gain and bandwidth of a vertical transistor structure.

Figure 4:
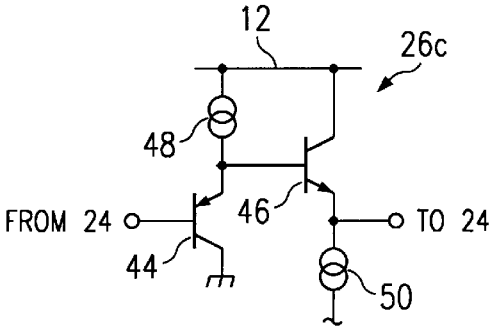
FIG. 4 is a circuit schematic of another embodiment of an emitter follower stage for the circuit of FIG. 1 and constructed according to the teachings of the present invention.

FIG. 4 illustrates another embodiment of an emitter follower circuit indicated generally at **26*c* for use in circuit 10 of FIG. 1. Emitter follower circuit 26*c* includes a PNP bipolar junction transistor 44 coupled in cascade with an NPN bipolar junction transistor 46. Transistor 44 is biased by current source 48 and transistor 46 is biased by current source 50. Emitter follower stage 26*c* introduces at least two benefits over emitter follower stages shown in FIGS. 2 and 3. First, the output impedance of emitter follower stage 26***c* is much lower than the output impedance of either emitter follower 26*a* or 26*b*. The output impedance of a bipolar junction transistor is approximately equal to the impedance at the base, including $r_\pi$ divided by the beta of the transistor. Emitter follower circuit 26*c* of FIG. 4 includes two emitter followers. Therefore, the output impedance is reduced by the product of the beta of transistor 44 and the beta of transistor 46. Additionally, emitter follower 26*c* also provides a favorable level shift that allows amplifier stage 24 to control emitter follower stage 26 more easily.

Figure 5:
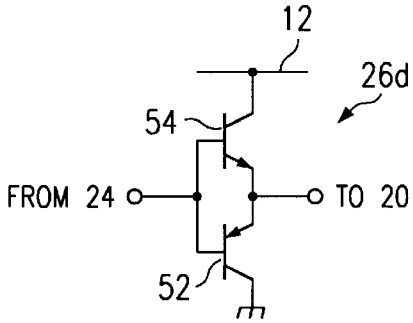
FIG. 5 is a circuit schematic of another embodiment of an emitter follower stage for the circuit of FIG. 1 and constructed according to the teachings of the present invention.

FIG. 5 illustrates another embodiment of an emitter follower circuit indicated generally at 26*d* for use in circuit 10 of FIG. 1. Emitter follower circuit 26*d* comprises a conventional class B output stage having a PNP transistor 52 and an NPN transistor 54. Transistors 52 and 54 are coupled together at their respective emitters to provide an output for emitter follower 26*d*. The base of transistor 54 and the base of transistor 52 are coupled to receive a common input from amplifier stage 24. An advantage of this emitter follower circuit is that it can provide high output current to pull up and pull down the voltage at the gate of the PMOS transistor, improving the transient response of the regulator.

Figure 6:
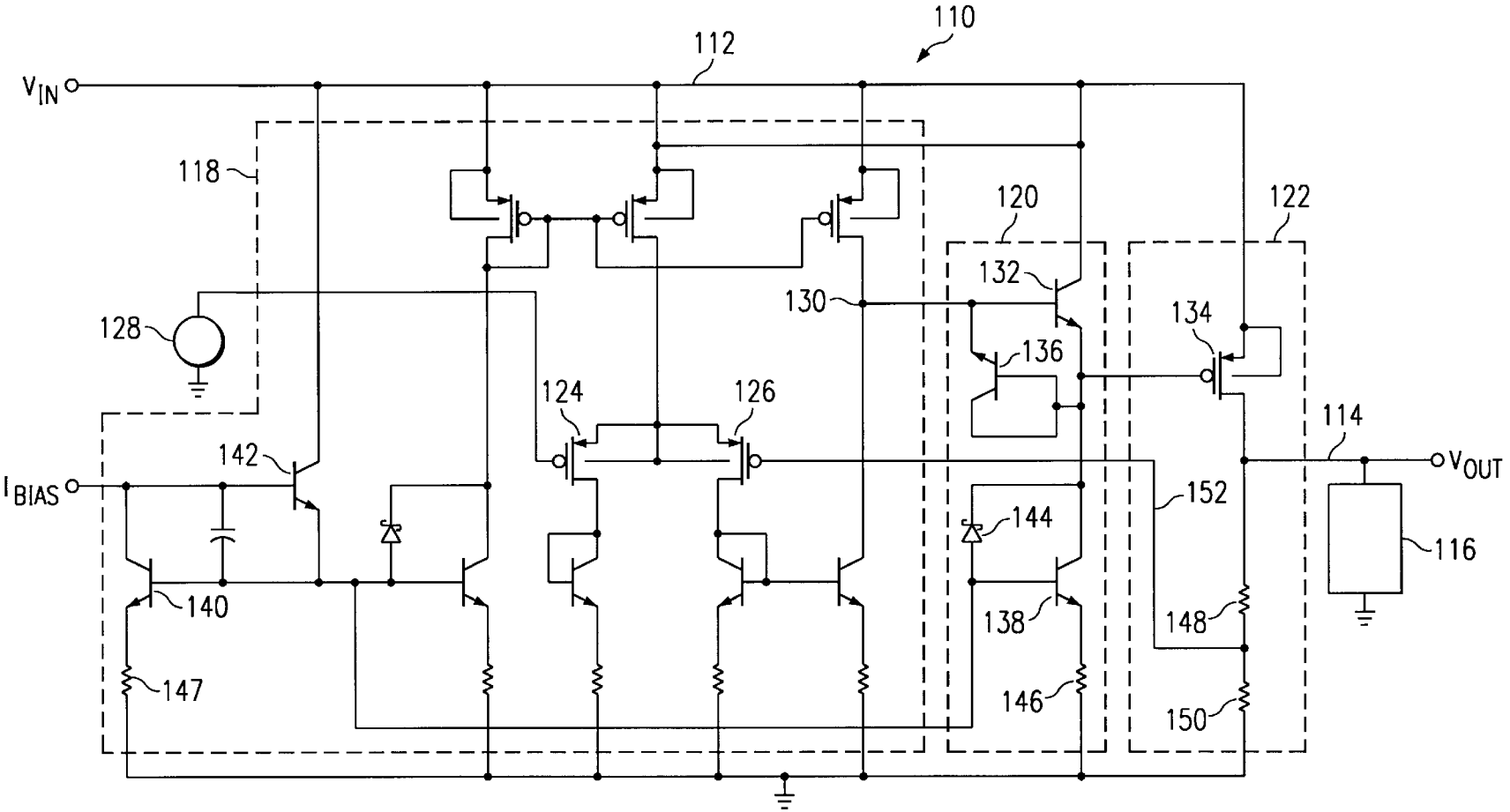
FIG. 6 is a circuit schematic illustrating another embodiment of a voltage regulator constructed according to the teachings of the present invention.

FIG. 6 is a circuit schematic illustrating another embodiment of a voltage regulator circuit indicated generally at 110 and constructed according to the teachings of the present invention. Voltage regulator 110 receives an input voltage labelled $V_{in}$ at power supply rail 112. Regulator circuit 110 provides a regulated output voltage at node 114 to a load 116. The output voltage is labelled $V_{out}$. Circuit 110 comprises an amplifier and gain stage 118, an emitter follower stage 120, and an output stage 122. As shown, amplifier stage 118 comprises a BiCMOS amplifier stage. Amplifier stage 118 of FIG. 6 is shown by way of example and not by way of limitation. Amplifier stage 118 may be replaced with other amplifier stages that are known in the industry to provide a large gain along with a large input impedance. Amplifier stage 118, as shown, comprises first and second PMOS input transistors 124 and 126 coupled as a standard differential pair. A reference voltage source 128 is coupled to a gate of transistor 124 to provide one input to amplifier stage 118. An output node 130 of amplifier stage 118 is coupled to emitter follower stage 120 at a base of transistor 132. Transistor 132 comprises an NPN bipolar junction transistor. A collector of transistor 132 is coupled to power supply rail 112. An emitter of transistor 132 is coupled to an input to output stage 122 at a gate of PMOS transistor 134. A diode coupled NPN transistor 136 may be coupled across the base emitter junction of transistor 132 to protect this junction from avalanche-induced beta degradation during operation. A current is supplied to transistor 132 by NPN bipolar junction transistor 138 that forms a current mirror with NPN bipolar junction transistors 140 and 142 of amplifier stage 118. Additionally, a Schottky diode 144 is coupled between the base of transistor 138 and its collector. This prevents the base-collector junction of transistor 138 from forward biasing. The emitters of transistors 138 and 140 are coupled through resistors 146 and 147 to ground.

Output stage 122 comprises PMOS transistor 134 and first and second resistors 148 and 150. A source of transistor 134 is coupled to power supply rail 112. A drain of transistor 134 is coupled to node 114 to provide output of regulator circuit 110. Additionally, resistor 148 is coupled between node 114 and node 152. Resistor 150 is coupled between node 152 and a ground potential. Node 152 is coupled to transistor 126 of amplifier 118 to provide negative feedback for circuit 110.

Circuit 110 of FIG. 6 operates in the manner described above with respect to FIG. 1. It is noted that emitter follower stage 120 may be replaced with any of the emitter follower stages shown in FIGS. 3 through 5 as described above.

Although the present invention has been described in detail, it should be understood that various changes, substitutions and alterations can be made hereto without departing from the spirit and scope of the invention as defined by the appended claims. For example, NPN and PMOS transistors in FIG. 1 may be changed to be PNP and NMOS transistors, respectively. The polarity of circuit 10 would thus be changed to provide a regulated negative output voltage.

What is claimed is:

1. An integrated circuit for regulating an input voltage, said circuit comprising:

an amplifier stage having first and second inputs and an output;

a first emitter follower having a PNP bipolar junction transistor with a base coupled to the output of the amplifier stage, a collector coupled to ground, and an emitter coupled to the input voltage through a current source;

a second emitter follower having a NPN bipolar junction transistor with a base coupled to the emitter of the first emitter follower circuit, a collector coupled to the input voltage, and an emitter coupled to ground through a current source, the first and second emitter followers forming an emitter follower stage having an output at the emitter of the NPN bipolar junction transistor; and an output stage having an MOS transistor with a gate coupled to said output of said follower stage, a drain coupled to said first input of the amplifier stage for providing negative feedback to said amplifier stage, and a source coupled to the input voltage such that the drain of the MOS transistor provides a regulated output voltage that is stable over a predetermined frequency range for a wide range of load impedances.

2. The circuit of claim 1, wherein a reference voltage power supply is coupled to said second input of said amplifier stage.

3. The circuit of claim 1, wherein said MOS transistor comprises a P-channel MOS transistor.

4. The circuit of claim 1, wherein said MOS transistor has a selected threshold voltage such that said emitter follower stage may cause said MOS transistor to conduct an insignificant quantity of current when the load enters an idle state.

5. The circuit of claim 1, and further comprising a voltage divider coupled between the drain of said MOS transistor and said first input of said amplifier stage so as to control the negative feedback and the level of the regulated output voltage.

6. The circuit of claim 1, wherein the absolute value of the threshold voltage of the MOS transistor is greater than one volt.

7. The circuit of claim 1, wherein the input voltage to the regulator circuit supplies power to operate the amplifier stage.

8. An integrated circuit for regulating an input voltage, said circuit comprising:

an amplifier stage having first and second inputs and an output;

a reference voltage power supply coupled to said second input of said amplifier stage;

a bipolar emitter follower stage having an NPN bipolar junction transistor with a collector coupled to the input voltage, a base coupled to said output of said amplifier stage, and an emitter coupled to ground through a current source;

a MOS transistor with a gate coupled to said emitter of said NPN transistor in said follower stage, a source coupled to the input voltage, and a drain;

a voltage divider coupled between the drain of said MOS transistor and said first input of said amplifier stage for providing negative feedback to said amplifier stage such that the drain of the MOS transistor provides a regulated output voltage that is stable over a predetermined frequency range for a wide range of load impedances.

9. The circuit of claim 8, wherein said MOS transistor comprises a p-channel MOS transistor.

10. The circuit of claim 8, wherein said MOS transistor has a selected threshold voltage such that said NPN transistor of said emitter follower stage may cause said MOS transistor to conduct an insignificant quantity of current when the load enters an idle state.

11. The circuit of claim 8, wherein said emitter follower stage further comprises a PNP emitter follower stage cascaded with said NPN bipolar junction transistor.

12. The circuit of claim 8, wherein the absolute value of the threshold voltage of the MOS transistor is greater than one volt.

* * * * *